US010070698B1

(12) United States Patent
Stein

(10) Patent No.: US 10,070,698 B1
(45) Date of Patent: Sep. 11, 2018

(54) CUFF LINKS WITH INTERCHANGEABLE DECORATIVE PLATES WITH IMPROVED QUICK-RELEASE MOUNTING

(71) Applicant: Corey Stein, Roslyn Heights, NY (US)

(72) Inventor: Corey Stein, Roslyn Heights, NY (US)

( * ) Notice: Subject to any disclaimer, the term of this patent is extended or adjusted under 35 U.S.C. 154(b) by 94 days.

(21) Appl. No.: 15/427,077

(22) Filed: Feb. 8, 2017

Related U.S. Application Data

(60) Provisional application No. 62/292,986, filed on Feb. 9, 2016.

(51) Int. Cl.
*A44B 5/02* (2006.01)
*A44B 5/00* (2006.01)

(52) U.S. Cl.
CPC ..... *A44B 5/02* (2013.01); *A44B 5/002* (2013.01)

(58) Field of Classification Search
CPC ..... A44B 5/02; A44B 5/002
See application file for complete search history.

(56) References Cited

U.S. PATENT DOCUMENTS

| | | | | |
|---|---|---|---|---|
| 188,206 | A | 3/1877 | Teters | |
| 613,039 | A | 10/1898 | Holden | |
| 686,193 | A | 11/1901 | Bailey | |
| 1,044,354 | A | 11/1912 | Collett | |
| 1,430,008 | A | 9/1922 | Eddy | |
| 2,483,031 | A | 9/1949 | Avedon | |
| 2,834,080 | A | 5/1958 | Corbi | |
| 3,509,734 | A * | 5/1970 | Lederer | A44C 17/0216 24/303 |
| 3,535,747 | A | 10/1970 | Benn | |
| 3,538,556 | A | 11/1970 | Shein | |
| 3,646,642 | A * | 3/1972 | Sitt | A44B 5/002 24/66.11 |
| 4,528,726 | A | 7/1985 | Kurashima | |
| 4,608,838 | A | 9/1986 | Gardner | |
| 5,974,634 | A | 11/1999 | Eisenpresser | |
| 6,588,067 | B2 | 7/2003 | Efron | |
| 6,594,871 | B2 | 7/2003 | Hoffman | |
| 8,516,663 | B2 | 8/2013 | Stoehr | |

(Continued)

FOREIGN PATENT DOCUMENTS

| | | |
|---|---|---|
| FR | 800756 | 7/1936 |
| FR | 2847130 | 5/2004 |

*Primary Examiner* — Robert Sandy
*Assistant Examiner* — David M Upchurch
(74) *Attorney, Agent, or Firm* — Thomas A. O'Rourke; Bodner & O'Rourke, LLP

(57) ABSTRACT

A cuff link may releasably secure two cuffs of a French cuff shirt, and is configured to interchangeably receive any of a plurality of decorative cover plates to easily/quickly change its appearance. The decorative cover plate is formed with a magnetic material. A base of the cuff link has a post extending therefrom, with a cross-member. The base also includes an opening with a peripheral side wall shaped to correspond to the decorative cover plate, and a bottom wall. The bottom wall has a flat first portion formed of a magnetic material, to magnetically couple the cover plate thereto. A second portion of the bottom wall is also flat, but formed at an angle to the first portion to permit pivotal movement of the decorative plate within the recess, to unsecure the magnetic coupling of the magnetic material of the decorative plate from the magnetic material of the first portion.

4 Claims, 6 Drawing Sheets

(56) References Cited

U.S. PATENT DOCUMENTS

| | | | | |
|---|---|---|---|---|
| 8,667,650 | B1 | 3/2014 | Duffin | |
| 9,021,833 | B2 | 5/2015 | Arjang | |
| 2003/0154576 | A1 | 8/2003 | Mirharooni | |
| 2006/0236509 | A1 | 10/2006 | Ausman | |
| 2010/0192631 | A1* | 8/2010 | Richmond ..... | A44C 25/002 63/23 |

* cited by examiner

CUFF LINKS WITH INTERCHANGEABLE DECORATIVE PLATES WITH IMPROVED QUICK-RELEASE MOUNTING

CROSS REFERENCES TO RELATED APPLICATIONS

This application claims priority on U.S. Provisional Application Ser. No. 62/292,986 filed on Feb. 9, 2016, the discloses of which are incorporated herein by reference.

FIELD OF THE INVENTION

The present invention relates to cuff links for securing the cuffs of a shirt together, and more particularly to an improved cuff link structural arrangement that may accommodate easy/quick interchangeable coupling of decorative plates thereto.

BACKGROUND OF THE INVENTION

A long-sleeved dress shirt typically terminates in a cuff, which may have a slit to permit a person to more easily receive the narrowed end of the sleeves over the person's hands when getting dressed, and undressed. The conventional dress shirt includes one or more buttons and corresponding button holes, on each of the two sides of the cuff, respectively, which may be used to secure the cuffs together. The cuffs being so secured may better encircle the person's wrist while the shirt is being worn, to prevent them from siding down When the person's arms are raised.

A dress shirt that uses a different arrangement (e.g., typical tuxedo shirt) may have button holes on both sides of the cuff, and is known as a French cuff, for which cuff links may be used to secure the two sides of the cuff together. Additionally , a convertible cuff shirt is configured for dual functionality, and has a button tend a button hole on each of the two cuffs, where the button may be withdrawn to be disposed between the cuffs, to alternatively accommodate use of a cuff link for decorative purposes.

Early versions of today's cuff links are shown by U.S. Pat. No. 188,206 to Teters for "Button-Fastening"; U.S. Pat. No. 613,039 to Holden for "Cuff Button"; U.S. Pat. No. 1,430,008 to Eddy for a "Separable Button"; and U.S. Pat. No. 2,483,031 to Avedon for "Magnetic Cuff Link."

Today's cuff links have a front facing member that resembles the button they replace and which is generally visible atop the upper cuff side, and a bottom facing surface from which extends a post that is to be positioned between the cuffs, and a cross member that may be pivotally attached to the distal end of the post to trap the cuff between it and the front facing member.

Since it may be desirable for many people to alter the appearance of the cuff links to match the color of the shirt or the suit being worn, the person wearing the French cuff shirt or convertible cuff shirt ordinarily would own multiple pairs of cuff links. To address this problem, prior art inventions have sought to provide for an interchangeable ornamental piece that may be used to change the appearance of the cuff links. Such prior art is shown, for example, by U.S. Pat. No. 3,535,747 to Benn; U.S. Pat. No, 3,538,556 to Shein; French Patent Publication FR2847130 to Benchimol Antonio; U.S. Pat. No. 4,608,838 to Gardner; U.S. Pat. No. 6,588,067 to Efron; U.S. Pat. No. 8,516,663 to Stoehr; and U.S. Pat. No. 8,667,650 to Duffin.

The present invention provides a unique structural arrangement that greatly enhances the ease of interchangeability of the decorative plates that may be used with the corresponding cuff link base.

OBJECTS OF THE INVENTION

It is an object of the invention to provide a cuff link to be used for a shirt with French cuffs.

It is another object of the invention to provide a cuff link that accommodates interchangeable decorative plates that may be releasably received by the cuff link base member, to easily change the appearance of a portion of the cuff link.

It is a further object of the invention to provide for releasable coupling of a decorative plate member to the cuff link base member.

It is another object of the invention to provide a quick release feature that permits quick separation and removal of the decorative plate that is coupled to the cuff link base member.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the present invention, an improved cuff link assembly may be used tot releasably securing together two cuffs of a French cuff shirt, and may be further configured to interchangeably receive any one of a plurality of different decorative cover plates that may be utilized to change us appearance.

The cuff link assembly disclosed herein may be formed of a base member with a post extending laterally from the base members and a cross member extending laterally from the post at a distal end of the post.

The decorative cover plate may have a magnet attached thereto, or may instead be formed of a magnetic material. The cover plate may be formed to have a periphery shaped as desired. The cuff link base may include an opening defining a recess that may have a peripheral side wall and a bottom wall. The peripheral side wall may be shaped to correspond to the shaped periphery of the decorative cover plate. The bottom wall may be formed with a first portion and a second portion. The first portion may have a magnet secured thereto, or may instead be formed of a magnetic material that may be substantially flat, to magnetically couple the decorative cover plate to the base.

The second portion of the bottom wall may be formed to be generally flat, and may be formed for at least a portion thereof to be at an angle to the first portion. The angle is particularly is configured so that when a user decides to change the decorative cover plate, be/she may apply pressure to the top of the plate and cause it to pivot within the recess, for the bottom of the cover plate to generally be in contact with the second portion of the bottom wall of the base member. The angle and this pivoting movement may be configured to unsecure the magnetic coupling of the magnetic material of the decorative cover plate from the magnetic material of the first portion, and to angle the opposite side of the cover plate outwardly and away from the base, so that the person can easily grasp it and remove the cover plate. The peripheral wall of the recess of the base member, and the periphery of the decorative cover plate may each be formed into a cylindrical shape, or a square shape, or a polygonal shape, of any other desired shape.

In another embodiment, the base member may be formed with a central portion that may be made of a magnetic material, and may also be formed with first, second, third, and fourth other portions that surround the magnetic central portion, each of which may be non -magnetic. Each of the first, second, third, and fourth other portions may be formed of equal areas and may be equally spaced about the central portion, and may thus each be formed into a "quadrant," depending upon the shape used (e.g., a north quadrant, a south quadrant, an east quadrant, and a west quadrant). Each of the first, second, third, and fourth other portions may be formed at a respective angle with respect to the central portion, so that any one of those four portions may accommodate uncoupling of the decorative cover plate from the base member, without the user needing to know the location of a single angled portion.

Other advantageous embodiments are also disclosed hereinafter.

BRIEF DESCRIPTION OF THE DRAWINGS

The description of the various example embodiments is explained in conjunction with appended drawings, in which.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases. "at least one", "one or more", and "and/or" are open-ended expressions that are both conjunctive and disjunctive in operation. For example, each of the expressions "at least one of A, B and C", "one or more of A, B, and C", and "A, B, and/or C" means all of the following possible combinations: A alone; B alone; or C alone; or A and B together; or A and C together,; or B and C together; or A, B and C together.

Also, all references (e.g., patents, patent publications, and non-patent literature) that are cited within this documents are incorporated herein in their entirety by reference.

Furthermore, the described features, advantages, and characteristics of any particular embodiment disclosed in the following specification, may be combined in any suitable manner with any of the other embodiments disclosed herein.

Figure 5:
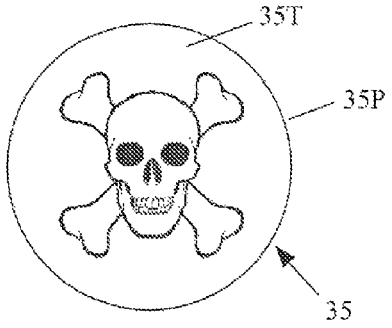
FIG. 5 illustrates a top view of the decorative plate of FIG. 4.
Figure 2:
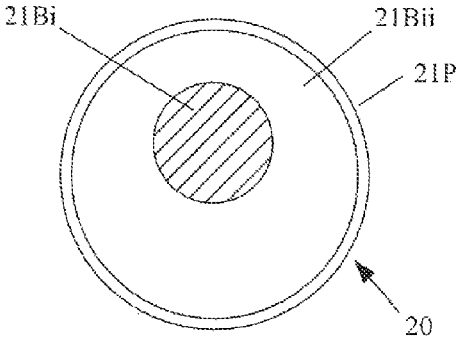
FIG. 2 illustrate a top view of the cuff link base member of FIG. 1.
Figure 4:
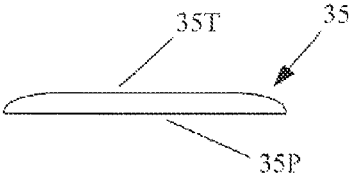
FIG. 4 illustrates a side view of an interchangeable decorative cover plate in accordance with the present invention.
Figure 1:
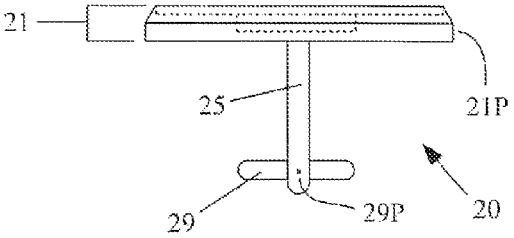
FIG. 1 illustrates as side view of a first embodiment of a cuff link base member in accordance with the present invention.
Figure 3:
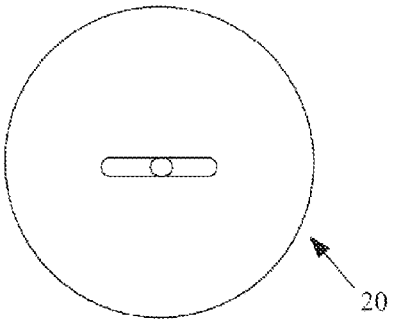
FIG. 3 illustrates a bottom view of the cuff link base member of FIG. 1.

FIGS. 1-3 show side, top, and bottom views of a cuff link base member 20, respectively, and FIGS. 4-5 show top and side views of one decorative cover plate 35, from among many such possible decorated cover plates, each of which may be interchangeably received within the base member.

The decorative cover plate 35 may have a bottom surface 35B, at least a portion of which may be substantially flat and may be formed of a magnetic material, or may instead have a magnet secured thereon to provide for such magnetic attraction with respect to the base 20 that may be similarly formed, as discussed hereinafter. The decorative cover plate 35 may also have a top surface 35T, which may be decorated in any desired fashion. It may be decorated with a single solid color, or a pattern of colors, or any image. The colors or the image may be painted thereon, or may be applied thereon as a sticker, or may be engraved thereon, of may be formed using any suitable technique known in the art. The top surface 35T may also be decorated with gem stones, etc., on at least a portion thereof, or it may be formed with any combination of colors/designs known in the art. The decorative cover plate 35 may be formed with any desired peripheral shape 35P, including, but not limited to, a circular shape, a square shape, a rectangular shape, a polygonal shape, a free-form shape, etc. In one embodiment, the circular shape may be desirably used, as shown in FIG. 5, as it may serve to better resemble the button typically found on regular cuff shirts.

The cuff link base member 20 may include a support member 21 that may abut a first cuff, a post/stem 25 that may extend from a lower surface of the support member, and a cross-member 29, which may be used to secure the cuff link with respect to the second cuff.

In one embodiment, the cross-member 29 may be integrally formed with the post/stem 25. In another embodiment, the cross-member 29 may be pivotally mounted proximate to a distal end of the post at 29P, as shown in FIG. 1, so that it may first be aligned with the post 25, for ease of insertion through the holes in the cuff, and may then be toggled to be substantially perpendicular to the stem, to trap the cuffs of the shirt between the support member and the cross-member.

Figure 1A:
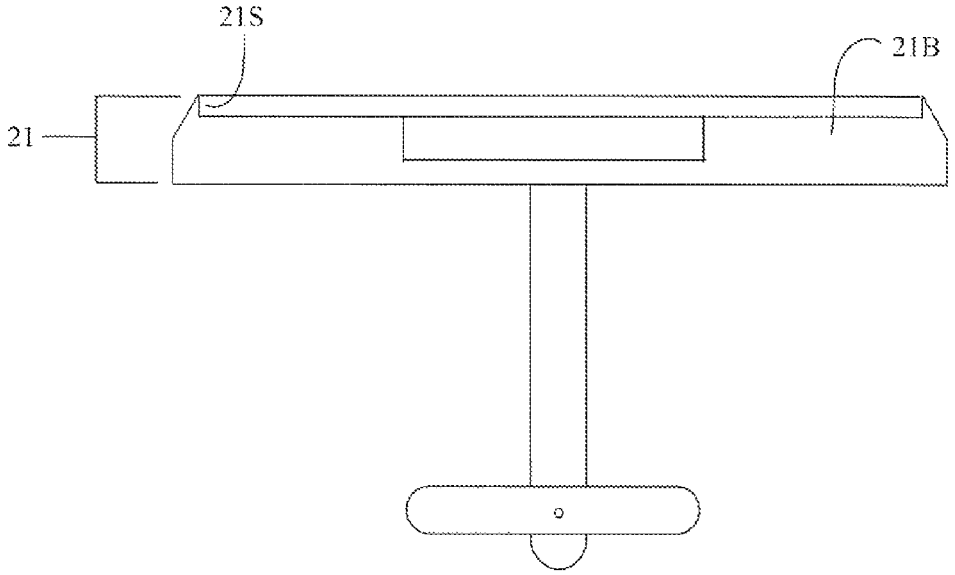
FIG. 1A is cross-sectional view through the cuff link base member of FIG. 1.

The exterior periphery 21P of the support member 21 may be formed to any desired shape, including, but not limited to, a circular shape, a square shape, a rectangular shape, a polygonal shape, etc. The top surface of the support member 21 may have an opening defining a cavity, and may form a peripheral side wall 21S and a bottom wall 21B (FIG. 1A). The peripheral side wall 21S may desirably be shaped to correspond to the shaped periphery 35P of the decorative cover plate, and in one embodiment may have a small clearance fit therebetween. In another embodiment, a slight friction fit may also be used. The bottom wall 21B may be formed or a magnetic material configured to magnetically couple the decorative cover plate to the base. The bottom wall 21B may be formed to be substantially flat, or may at least have a sufficient surface area thereon that is formed to be flat or otherwise, as long as it may provide sufficient magnetic attraction with the decorative cover plate 35, to prevent inadvertent separation of the cover plate from the base.

In another embodiment, the bottom wall 21B may be formed to have a first portion 21B*i* that is formed of a magnetic material configured to magnetically couple the decorative cover plate to the base, and a second portion 21B*ii*, which may not be magnetic. Alternatively, a recess may be formed in the bottom wall 21B and a separate magnet may be fixedly secured (i.e., be inset) within the recess, to be used to magnetically couple the decorative cover plate 35 to the base 21. In another embodiment, two or more separate magnets may be used. The magnet(s) or magnetic second portion 21B*ii* may be circular in shape, as shown in FIG. 2, or may be formed to have another shape (e.g., square shaped). The magnetic second portion 21B*ii* may be centrally positioned within the cavity, or may be disposed away from the center to one side. In one embodiment, the bottom of the cavity may be flat across the entirety of the bottom wall 21B, such that the exposed surface of the magnet or magnetic second portion 21B*ii* may be coplanar with the substantially flat first portion 21B*i*. In another embodiment, the magnetic portion or the separate magnet may be raised above the nonmagnetic bottom wall portion 21B*i* a distance R, and may in one embodiment be raised 1.2 mm (0.045 inches) above the bottom wall (see e.g., FIG. 10D).

Figure 8:
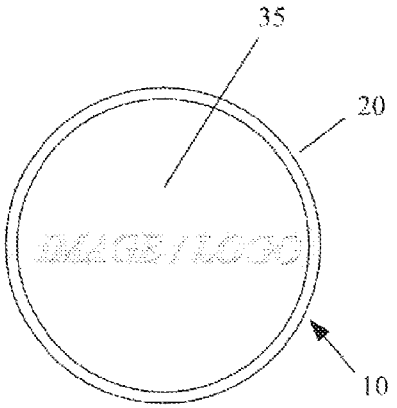
FIG. 8 illustrates a top view of the magnetically coupled decorative plate and cuff link base member shown in FIG. 7.
Figure 7:
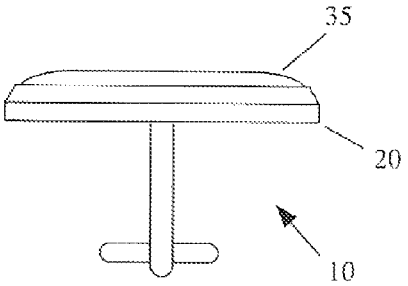
FIG. 7 illustrates the side view of FIG. 6, but is shown with the decorative plate magnetically coupled to the cuff link base member.
Figure 6:
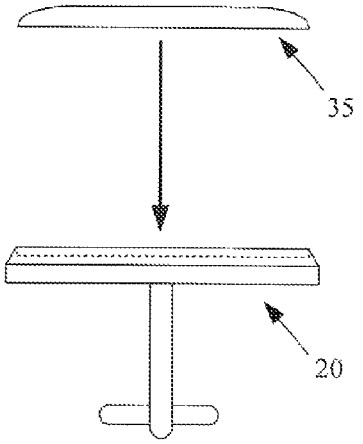
FIG. 6 illustrates a side view of the decorative plate of FIG. 4 just prior to being received by the cuff link base member of FIG. 1.

FIG. 6 shows the decorative cover plate 35 being moved toward the cavity of the support member 21, and FIGS. 7-8 show the decorative cover plate 35 magnetically coupled to the support member 21 to form a cuff link assembly 10. As shown therein, a portion of the cover plate 35 may be received within the cavity of the base member 20, and may be positively secured thereto, and a portion of the plate may be positioned above the top of the periphery of the circumferential wall of the support member 21.

Figure 10:
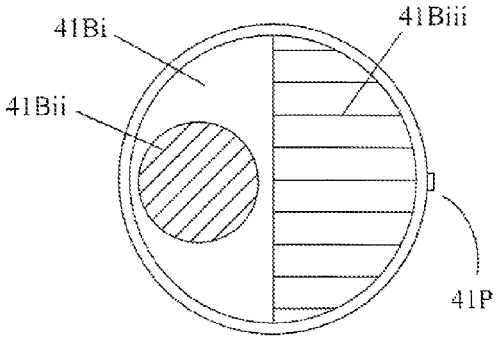
FIG. 10 is a top view of the cuff link base member of FIG. 9.
Figure 9A:
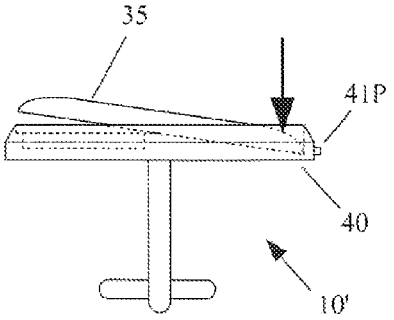
FIG. 9A is a side view illustrating uncoupling of the decorative cover plate of FIG. 4 from the cuff link base member of FIG. 9, using the angled depression in the base member.
Figure 9:
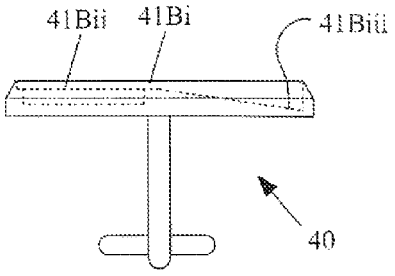
FIG. 9 illustrates a side view of an alternate embodiment of a cuff link base member in accordance with the present invention.
Figure 10A:
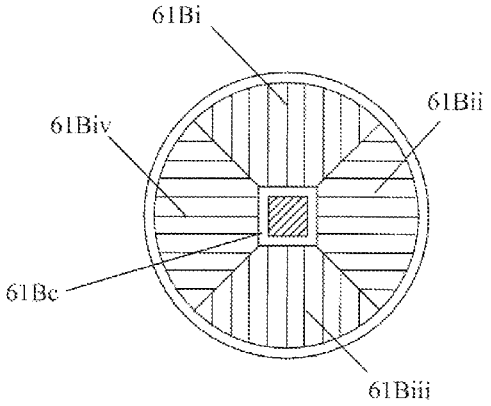
FIG. 10A is a top view showing an alternate embodiment for a base member of the cuff link assembly disclosed herein.
Figure 10C:
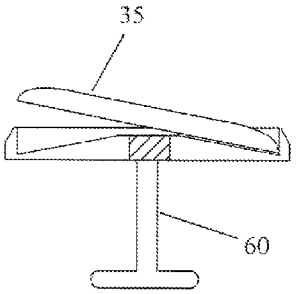
FIG. 10C is the cross-sectional view of FIG. 10B, but also illustrates uncoupling of the decorative cover plate of FIG. 4 from the cuff link base member using one of the four angled bottom wall portions in the base member.
Figure 10B:
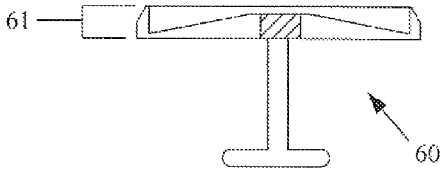
FIG. 10B is cross-sectional view through the base member of FIG. 10A.
Figure 10D:
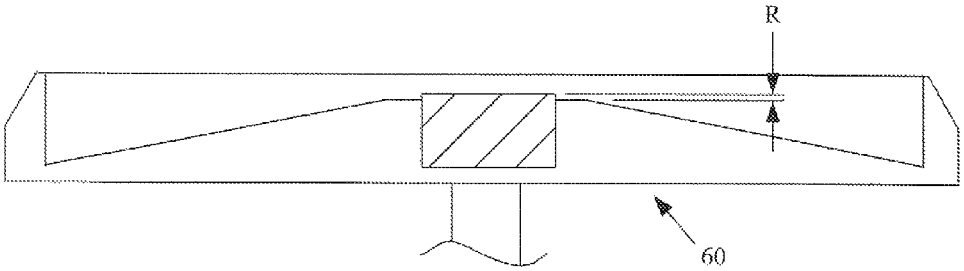
FIG. 10D is an enlarged detail view of a portion of the base member shown in the cross-sectional view of FIG. 10B.

FIGS. 9-10 show views of a cuff link base member 40—an alternate embodiment of the cuff link base member 20 shown in FIGS. 1-2. Cuff link base member 40 may have first and second bottom wall portions 41B*i* and 41B*ii* formed similar to the wall portions 21B*i* and 21B*ii* (i.e., it may have a portion formed of a magnetic material or have a magnet inset therein, and may have a nonmagnetic portion); however, those first and second bottom wall portions 41B*i* and 41B*ii* may be disposed to one side (e.g., only half) of the bottom wall 41B. A third bottom wall portion 41B*iii* may also be formed therein, but which may generally be angled downwardly with respect to the surface of the first and/or second bottom wall portions, as seen in FIG. 9. The third wall portion 41B*iii* may also be formed to be substantially flat. In another embodiment the third wall portion, rather than being angled with respect to the first and second wall portions 41B*i* and 41B*ii*, may instead be just offset therefrom but parallel (i.e., forms a step), and/or may alternatively be offset and angled (not shown).

When a decorative cover plate 35 is magnetically coupled to the support member 41 of the cuff link base member 40 to form cuff link assembly 10', seen in FIG. 9A, it may be easily removed by pressing down on the side of the cover plate above the angled third wall portion 41B*iii*. To better inform the user as to which side of the decorative cover plate 35 to depress to cause decoupling, a raised indicator protrusion 41P may be positioned on the side of the cuff link base member 40, and it may be clocked to where the cavity portion 41C*ii* is deepest.

FIGS. 10A-10D illustrate a base member embodiment 61, which may include a central portion 61B*c*, which may be square shaped, at least a portion of which may be magnetic (as shown by the cross-hatched region of FIG. 10A), and four other wall portions 61B*i*, 61B*ii*, 61B*iii*, and 61B*iv*. Each of those four other wall portions 61B*i*/61B*ii*/61B*iii*/61B*iv* may be angled with respect to the central portion 61B*c*. This arrangement may make it easier for the user to remove the decorative cover plate 35, as it may provide a steeper angle and greater separation of the angled cover plate with respect to the base when depressed by the user (compare FIG. 9A and FIG. 10C). This arrangement may also eliminate the desire to know the position at which of the angled recess portion is formed within the base, as each of the four quadrants may serve to uncouple the cover plate 35 from the base 61. Even if the user happened to place a finger on the transition between those surfaces when seeking to uncouple the cover plate 35, all that is required if no uncoupled occurs immediately would be to roll the finger to one side or the other to cause the uncoupling.

Figure 12:
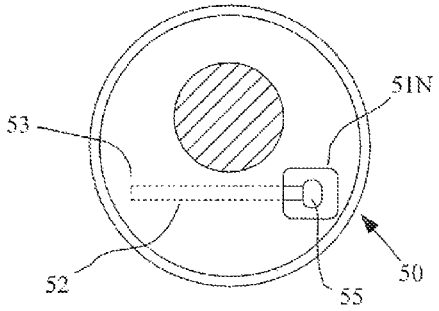
FIG. 12 is a top view of the cuff link base member of FIG. 11.
Figure 11:
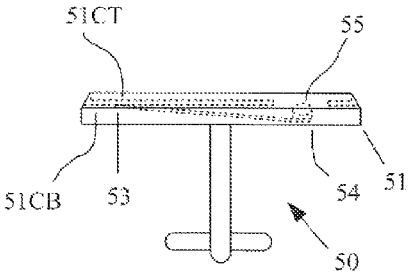
FIG. 11 illustrates a side view of another embodiment of a cuff link base member in accordance with the present invention.
Figure 13:
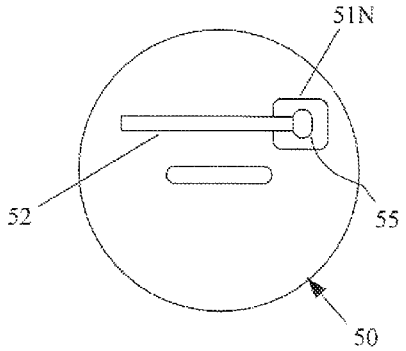
FIG. 13 is a bottom view of the cuff link base member of FIG. 11.

FIGS. 11-13 show views of a cuff link base member 50—an alternate embodiment of the cuff link base member 20. Cuff link base member 50 may be constructed the same as cuff link base member 20, except that in addition to a cavity 51CT being formed in a top of its support member 51, a cavity 51CB may also be formed in its bottom, as seen in FIG. 11. A through-opening 51N may be formed in the bottom wall of the support member 51. A lever arm 52 may have a first end 53 be fixedly secured to the bottom of the support member 51 within the cavity 51CB, and may have a second end 54 be disposed roughly centered upon the opening 51N, as seen in FIG. 11. The second end 54 of the lever arm 52 may have a bulbous member 55 formed thereon or be secured thereto, and which may be centered upon the opening 51N. The lever arm 52 may be secured to the support member 51 and be formed to generally be angled/curved away from the bottom surface of the support member within cavity 51CB. The top of the bulbous member 63 may be disposed below the top surface of the top cavity, to not obstruct placement of a decorative plate 35 thereon, and the second end 54 of the lever arm 52 may be contained within the bottom cavity 51CB, as seen in FIG. 11.

Figure 14:
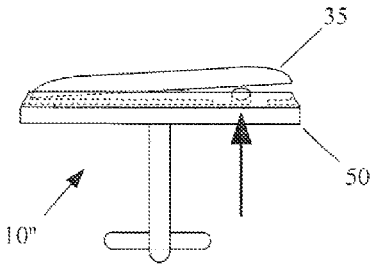
FIG. 14 is a side view illustrating uncoupling of a decorative plate from the cuff link base member of FIG. 11, using the cantilevered lever arm and bulbous member that are attached the base.

When a decorative cover plate 35 is magnetically coupled to the support member 51 of the cuff link base member 50 to form cuff link assembly 10", it may be easily removed, as seen in FIG. 14, by pressing upwardly on the lever arm 60 proximate to its second end 62, to cause the bulbous member 63 to engage and drive the cover plate to separate from the magnet.

While illustrative implementations of one or more embodiments of the present invention are provided hereinabove, those skilled in the art and having the benefit of the present disclosure will appreciate that further embodiments may be implemented with various chances within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A cuff link assembly, for use in releasably securing together two cuffs of a French cuff shirt, and being configured to interchangeably receive any one of a plurality of decorative cover plates that may be utilized to change an appearance of said cuff link assembly, said cuff link assembly comprising:

said decorative cover plate formed of a magnetic material, and having a shaped periphery said cover plate having a top surface and a bottom surface and wherein said bottom surface is substantially flat;

a cuff link base, said cuff link base comprising an opening defining a recess with a peripheral side wall shaped to correspond to said shaped periphery of said decorative cover plate, and a bottom wall; said bottom wall comprising:

a first portion being substantially flat and having said first portion at a first level in said base and comprising a magnetic material configured to magnetically couple a portion of said decorative cover plate to said base; and a second portion, said second portion of said bottom wall formed to be substantially flat and having said second portion at a second level in said base, said second level separated from said cover plate when said cover plate is in said cuff link base, and, wherein said decorative cover plate is pivotable within said recess when pressure is placed on the portion of the cover plate over said second portion, to unsecure said magnetic coupling of said magnetic material of said decorative cover plate from said magnetic material of said first portion thereby permitting said cover plate to be removed from said base;

a post extending laterally from said base member; and a cross member extending laterally from said post proximate to a distal end of said post.

2. The cuff link assembly according to claim 1 wherein said peripheral wall of said recess of said base member, and said periphery of said decorative cover plate are each formed to a cylindrical shape.

3. A cuff assembly comprising:

a cover plate comprising a magnetic material, and having a shaped periphery;

a cuff link base, said cuff link base comprising an opening defining a recess with a peripheral side wall and a bottom wall, said peripheral side wall shaped to correspond to said shaped periphery of said cover plate; said bottom wall comprising: a first portion and a second portion, said first portion being substantially flat and said first portion being at a first level with respect to said cover plate when said cover plate in positioned in said base, at least a portion of said first portion comprising a magnetic material configured to magnetically couple said cover plate to said base, said second portion of said bottom wall at a second level in said base, said second level being further away from said decorative cover plate than said first portion and wherein said decorative cover plate is pivotable within said recess when pressure is placed on the portion of the decorative cover plate over said second portion, to unsecure said magnetic coupling of said magnetic material of said cover plate from said magnetic material of said first portion;

a post extending from said base member; and a cross member extending from said post.

4. The cuff link assembly according to claim 3 wherein said peripheral wall of said recess of said base member, and said periphery of said cover plate are each formed to a cylindrical shape.

* * * * *